US008643557B2

(12) United States Patent
Nakano et al.

(10) Patent No.: US 8,643,557 B2
(45) Date of Patent: Feb. 4, 2014

(54) ANTENNA APPARATUS AND RADIO COMMUNICATION APPARATUS

(75) Inventors: Shinichi Nakano, Kanagawa-ken (JP); Kazunari Kawahata, Kanagawa-ken (JP); Nobuhito Tsubaki, Kanagawa-ken (JP); Kenichi Ishizuka, Kanagawa-ken (JP); Shigeyuki Fujieda, Ishikawa-ken (JP)

(73) Assignee: Murata Manufacturing Co., Ltd., Kyoto-Fu (JP)

( * ) Notice: Subject to any disclaimer, the term of this patent is extended or adjusted under 35 U.S.C. 154(b) by 45 days.

(21) Appl. No.: 12/710,945

(22) Filed: Feb. 23, 2010

(65) Prior Publication Data

US 2010/0149053 A1 Jun. 17, 2010

Related U.S. Application Data

(63) Continuation of application No. PCT/JP2008/060962, filed on Jun. 16, 2008.

(30) Foreign Application Priority Data

Aug. 24, 2007 (JP) ..... 2007-217968

(51) Int. Cl.
*H01Q 11/12* (2006.01)

(52) U.S. Cl.
USPC ..... 343/744; 343/745; 343/748

(58) Field of Classification Search
USPC ..... 343/702, 744, 745, 748, 750, 722
See application file for complete search history.

(56) References Cited

U.S. PATENT DOCUMENTS

| | | | | |
|---|---|---|---|---|
| 7,671,815 | B2 * | 3/2010 | Thornell-Pers et al. | 343/722 |
| 2005/0243001 | A1 | 11/2005 | Miyata et al. | |
| 2006/0268191 | A1 | 11/2006 | Hsieh | |

FOREIGN PATENT DOCUMENTS

| | | | |
|---|---|---|---|
| DE | 11 2004 000 869 | T5 | 3/2006 |
| EP | 1843432 | A1 * | 10/2007 |
| EP | 2 043 196 | A1 | 4/2009 |
| JP | 2002-158529 | A | 5/2002 |
| JP | 2002158529 | A * | 5/2002 |
| JP | 2006-067234 | A | 3/2006 |
| WO | 2006/080141 | A1 | 8/2006 |

OTHER PUBLICATIONS

Tony R. Kuphaldt, Lessons In Electric Circuits, Jul. 25, 2007, The Design Science License, Sixth Edition, vol. 2, pp. 189-215.*

(Continued)

*Primary Examiner* — Hoang V Nguyen
*Assistant Examiner* — Kyana R McCain
(74) *Attorney, Agent, or Firm* — Studebaker & Brackett PC

(57) ABSTRACT

An antenna apparatus and a radio communication apparatus are capable of separately controlling a resonance frequency in a basic mode and a resonance frequency in a higher mode and have a wide bandwidth in which the resonance frequency in the basic mode is variable. The antenna apparatus includes a feeding electrode 2, a loop-shaped radiation electrode 3, a capacitance portion 4, and inductors 5 and 6. The capacitance portion 4 is formed by a gap between an open end 3*a* of the loop-shaped radiation electrode 3 and the feeding electrode 2. The inductor 5 is disposed at a position where a large current is obtained in the basic mode and a small current is obtained in the higher mode. The inductor 6 is disposed at a position where a large current is obtained in the higher mode and a small current is obtained in the basic mode.

18 Claims, 9 Drawing Sheets

(56) References Cited

OTHER PUBLICATIONS

Written Opinion of the International Searching Authority; PCT/JP2008/060962; Jul. 15, 2008.

International Search Report; PCT/JP2008/060962; Jul. 15, 2008.

The extended European Search Report dated May 15, 2013, which corresponds to EP Application No. 08765645.0-1812 and is related to U.S. Appl. No. 12/710,945.

* cited by examiner

PRIOR ART

ANTENNA APPARATUS AND RADIO COMMUNICATION APPARATUS

CROSS REFERENCE TO RELATED APPLICATIONS

The present application is a continuation of International Application No. PCT/JP2008/060962, filed Jun. 16, 2008, which claims priority to Japanese Patent Application No. 2007-217968 filed Aug. 24, 2007, the entire contents of each of these applications being incorporated herein by reference in their entirety.

BACKGROUND OF THE INVENTION

1. Field of the Invention

The present invention relates to a variable-frequency antenna apparatus installed in a mobile telephone or the like and a radio communication apparatus.

2. Description of the Related Art

Japanese Unexamined Patent Application Publication No. 2002-158529, Japanese Unexamined Patent Application Publication No. 2005-318336, and WO 2004/109850 disclose antenna apparatuses.

In the antenna apparatus disclosed in Japanese Unexamined Patent Application Publication No. 2002-158529, the open end of a loop-shaped radiation electrode faces an electrode portion on the side of a feeding end with a gap therebetween, and a capacitor is formed between the open end and the electrode portion on the side of the feeding end. If a high-frequency current is supplied in the antenna apparatus, the antenna apparatus operates at a resonance frequency in a basic mode and a resonance frequency in a higher mode. By changing the gap between the open end of the radiation electrode and the electrode portion on the side of the feeding end so as to change the value of the capacitor, it is possible to change the resonance frequency in the basic mode and the resonance frequency in the higher mode.

In the antenna apparatus disclosed in Japanese Unexamined Patent Application Publication No. 2005-318336, a parallel radiation electrode pattern is connected in parallel to a surface-mount antenna component so as to form a parallel resonance circuit. The parallel resonance circuit is disposed in a non-ground region. If a high-frequency current is supplied in the antenna apparatus, the antenna apparatus operates at a resonance frequency in a basic mode and a resonance frequency in a higher mode. By changing a gap between a pair of electrodes forming a capacitor portion of the surface-mount antenna component so as to change the value of the capacitor portion, it is possible to change the resonance frequency in the basic mode and the resonance frequency in the higher mode.

In the antenna apparatus disclosed in WO 2004/109850, a loop-shaped radiation electrode including an open end and a feeding end facing the open end with a gap therebetween is disposed in a non-ground region, and a variable-frequency circuit including a variable-capacitance element is provided on a loop path of the radiation electrode. It is possible to change a resonance frequency in a basic mode and a resonance frequency in a higher mode using the variable-frequency circuit. Furthermore, by controlling the variable-capacitance element, it is possible to make a frequency variable bandwidth wider than the bandwidth of the radiation electrode.

However, the above-described antenna apparatuses have the following problems. In the antenna apparatuses disclosed in Japanese Unexamined Patent Application Publication No. 2002-158529 and Japanese Unexamined Patent Application Publication No. 2005-318336, since the resonance frequency in the basic mode and the resonance frequency in the higher mode are changed by changing the gap between electrodes so as to change the value of the capacitor formed between these electrodes, the resonance frequency in the basic mode and the resonance frequency in the higher mode are simultaneously changed.

In the antenna apparatus disclosed in WO 2004/109850, although it is possible to perform bandwidth control over a wide frequency band using the variable-frequency circuit, as in the antenna apparatuses disclosed in Japanese Unexamined Patent Application Publication No. 2002-158529 and Japanese Unexamined Patent Application Publication No. 2005-318336, the resonance frequencies in the basic mode and the resonance frequency in the higher mode are simultaneously changed and cannot be separately changed.

In a monopole antenna such as the antenna apparatus disclosed in WO 2004/109850, a current I1 in the basic mode and a current I2 in the higher mode (a harmonic having a frequency of three times that of the basic mode) are distributed as illustrated in FIG. 18. Accordingly, by providing a variable-frequency circuit 200 provided with a variable-capacitance element at a position corresponding to zero of the current I2 in the higher mode as indicated by a broken line, it is possible to change the resonance frequency in the basic mode and fix the resonance frequency in the higher mode. That is, only the resonance frequency in the basic mode can be changed. However, if the variable-frequency circuit 200 is provided at the position corresponding to zero of the current I2 in the higher mode, the variable-frequency circuit 200 is provided at a position corresponding to a current I1' in the basic mode. The current I1' is smaller than a current Imax of the feeding portion. Accordingly, even if the value of the variable-capacitance element is changed, a bandwidth in which the resonance frequency in the basic mode is variable becomes narrow. The antenna apparatus therefore lacks in practicability.

SUMMARY OF THE INVENTION

The present invention has been developed in view of the above-described problems, and it is an object of the present invention to provide an antenna apparatus and a radio communication apparatus capable of separately controlling a resonance frequency in a basic mode and a resonance frequency in a higher mode, as well as having a wide bandwidth in which the resonance frequency in the basic mode is variable.

An embodiment of the present invention provides an antenna apparatus that includes a feeding electrode and a loop-shaped radiation electrode in a non-ground region of a substrate and operates at a resonance frequency in a basic mode and a resonance frequency in a higher mode. The feeding electrode has one end connected to a feeding portion for supplying a current of a predetermined frequency. The loop-shaped radiation electrode extends in a state where a base end of the loop-shaped radiation electrode is connected to the other end of the feeding electrode and has an open end facing the other end of the feeding electrode.

The antenna apparatus includes: a capacitance portion for passing a current of the resonance frequency in the higher mode and blocking a current of the resonance frequency in the basic mode which is formed by a gap between the open end of the loop-shaped radiation electrode and the feeding electrode; a first reactance circuit for passing a current of the resonance frequency in the basic mode and blocking a current of the resonance frequency in the higher mode which is disposed near the capacitance portion on the side of the base end of the loop-shaped radiation electrode; and a second reactance circuit for passing a current of the resonance frequency in the higher mode which is disposed near a position on the side of the open end of the loop-shaped radiation electrode where the maximum current of the resonance frequency in the higher mode is obtained.

In the above-described antenna apparatus, if a current is supplied from the feeding portion to the feeding electrode in the basic mode, the current flows into the base end of the loop-shaped radiation electrode, passes through the first reactance circuit, and is blocked by the capacitance portion. As a result, the current that resonates in the basic mode is large at the feeding electrode on the side of the loop-shaped radiation electrode, and is reduced toward the open end of the loop-shaped radiation electrode. Since the first reactance circuit is on the side of the base end of the loop-shaped radiation electrode, it is possible to control the resonance frequency in the basic mode by changing the reactance value of the first reactance circuit.

On the other hand, in the above-described antenna apparatus, if a current is supplied from the feeding portion to the feeding electrode in the higher mode, the current passes through the capacitance portion, flows into the open end of the loop-shaped radiation electrode, passes through the second reactance circuit, and is blocked by the first reactance circuit. As a result, the current that resonates in the higher mode is large on the side of the feeding electrode, is the minimum at the capacitance portion, is increased toward a center portion from the open end of the loop-shaped radiation electrode, and is reduced toward the base end of the loop-shaped radiation electrode. Accordingly, since the second reactance circuit is disposed near a position on the side of the open end of the loop-shaped radiation electrode where the maximum current of the resonance frequency in the higher mode is obtained, it is possible to control the resonance frequency in the higher mode by changing the reactance value of the second reactance circuit.

As described previously, although it is possible to control the resonance frequency in the basic mode by changing the reactance value of the first reactance circuit, the change in the reactance value of the first reactance circuit may affect the resonance frequency in the higher mode. However, in the present invention, since the first reactance circuit is disposed at a position near the capacitance portion where the minimum current is obtained in the higher mode, the resonance frequency in the higher mode is not changed even if the reactance value of the first reactance circuit is changed.

Furthermore, as described previously, although it is possible to control the resonance frequency in the higher mode by changing the reactance value of the second reactance circuit, the change in the reactance value of the second reactance circuit may affect the resonance frequency in the basic mode. However, in the present invention, since the second reactance circuit is disposed at a position on the side of the open end of the loop-shaped radiation electrode where a small current is obtained in the basic mode, the resonance frequency in the basic mode is not changed even if the reactance value of the second reactance circuit is changed. That is, using the first reactance circuit and the second reactance circuit, it is possible to separately control the resonance frequency in the basic mode and the resonance frequency in the higher mode.

In another embodiment of the present invention, in the antenna apparatus according to the above-described embodiment, in which a reactance value of the first reactance circuit is larger than that of the second reactance circuit, a reactance value of the first reactance circuit is smaller than that of the capacitance portion in the basic mode, and a reactance value of the first reactance circuit is larger than that of the capacitance portion in the higher mode. As a result, since the reactance value of the first reactance circuit is larger than that of the second reactance circuit, the current in the higher mode is blocked by the first reactance circuit with certainty after passing through the second reactance circuit.

Furthermore, since the reactance value of the first reactance circuit is smaller than that of the capacitance portion in the basic mode, the current in the basic mode is blocked by the capacitance portion with certainty after flowing into the first reactance circuit and passing through the first reactance circuit. Still furthermore, since the reactance value of the first reactance circuit is larger than that of the capacitance portion in the higher mode, the current in the higher mode flows into the capacitance portion and is blocked by the first reactance circuit with certainty.

The invention according another embodiment provides the antenna apparatus in which a variable-capacitance element is connected in series to the first reactance circuit. As a result, it is possible to tune the resonance frequency in the basic mode within a wide band using the variable-capacitance element.

The invention according to another embodiment provides the antenna apparatus in which each of the first reactance circuit and the second reactance circuit is an inductor. As a result, each of the first reactance circuit and the second reactance circuit can have a simple configuration.

The invention according to another embodiment provides the antenna apparatus in which the first reactance circuit is a series circuit or a parallel circuit including an inductor and a capacitor, and the second reactance circuit is an inductor. As a result, it is possible to significantly change the reactance value of the first reactance circuit in accordance with a frequency.

The invention according to another embodiment provides the antenna apparatus in which the loop-shaped radiation electrode, the feeding electrode, the capacitance portion, the first reactance circuit, and the second reactance circuit are disposed on a dielectric substrate disposed on the non-ground region. As a result, it is possible to strengthen the capacitive coupling of the capacitance portion.

The invention according to another embodiment provides the antenna apparatus in which a first matching inductor is disposed between the feeding electrode and the feeding portion, and a second matching inductor is disposed so that one end of the second matching inductor is connected to a connecting portion connecting the first matching inductor and the feeding portion to each other and the other end of the second matching inductor is connected to a ground region of the substrate.

The invention according to another embodiment provides the antenna apparatus in which one or more branched radiation electrodes that branch off from the loop-shaped radiation electrode near the first reactance circuit are disposed. As a result, it is possible to increase the number of resonance frequencies by increasing the number of branched radiation electrodes.

The invention according to another embodiment provides the antenna apparatus in which the first reactance circuit and the second reactance circuit are disposed on only a side surface of the dielectric substrate. As a result, it is possible to dispose the radiation electrode at an allowable antenna height.

The invention according to another embodiment provides a radio communication apparatus including the antenna apparatus described above.

As described previously in detail, according to an antenna apparatus according to the above-summarized embodiments, it is possible to separately control the resonance frequency in the basic mode and the resonance frequency in the higher mode.

In particular, according to the invention according to the embodiments above, since it is possible to tune the resonance frequency in the basic mode within a wide band, it is possible to transmit/receive radio waves for digital terrestrial television broadcasting or the like using a wide bandwidth with certainty.

According to the invention according to the above-described embodiments, it is possible to reduce the number of components for the first reactance circuit and the second reactance circuit. As a result, the cost reduction of the antenna apparatus can be achieved.

According to the invention according to the above-described embodiments, since the reactance value in the higher mode can be increased while holding the reactance value in the basic mode, it is possible to block the higher mode with certainty.

According to the invention according to the above-summarized embodiments, since it is possible to strengthen the capacitive coupling of the capacitance portion, it is possible to easily control the resonance frequency in the higher mode. Furthermore, since components of the antenna apparatus are three-dimensionally disposed on the dielectric substrate, it is possible to reduce the footprint of the antenna apparatus.

According to the invention according to the above-summarized embodiments, since it is possible to increase the number of resonance frequencies, it is possible to transmit/receive radio waves in many frequency bands.

According to the invention according to the above-summarized embodiments, since it is possible to dispose the loop-shaped radiation electrode at an allowable antenna height, it is possible to further minimize the antenna apparatus and further enhance the efficiency of the antenna apparatus.

According to the invention according to the above-summarized embodiments, in a radio communication apparatus, it is possible to separately control the resonance frequency in the basic mode and the resonance frequency in the higher mode. Furthermore, it is possible to transmit/receive radio waves for digital terrestrial television broadcasting or the like using a wide bandwidth with certainty.

DESCRIPTION OF THE PREFERRED EMBODIMENTS

Embodiments of the present invention will be described with reference to the accompanying drawings.

Figure 1:
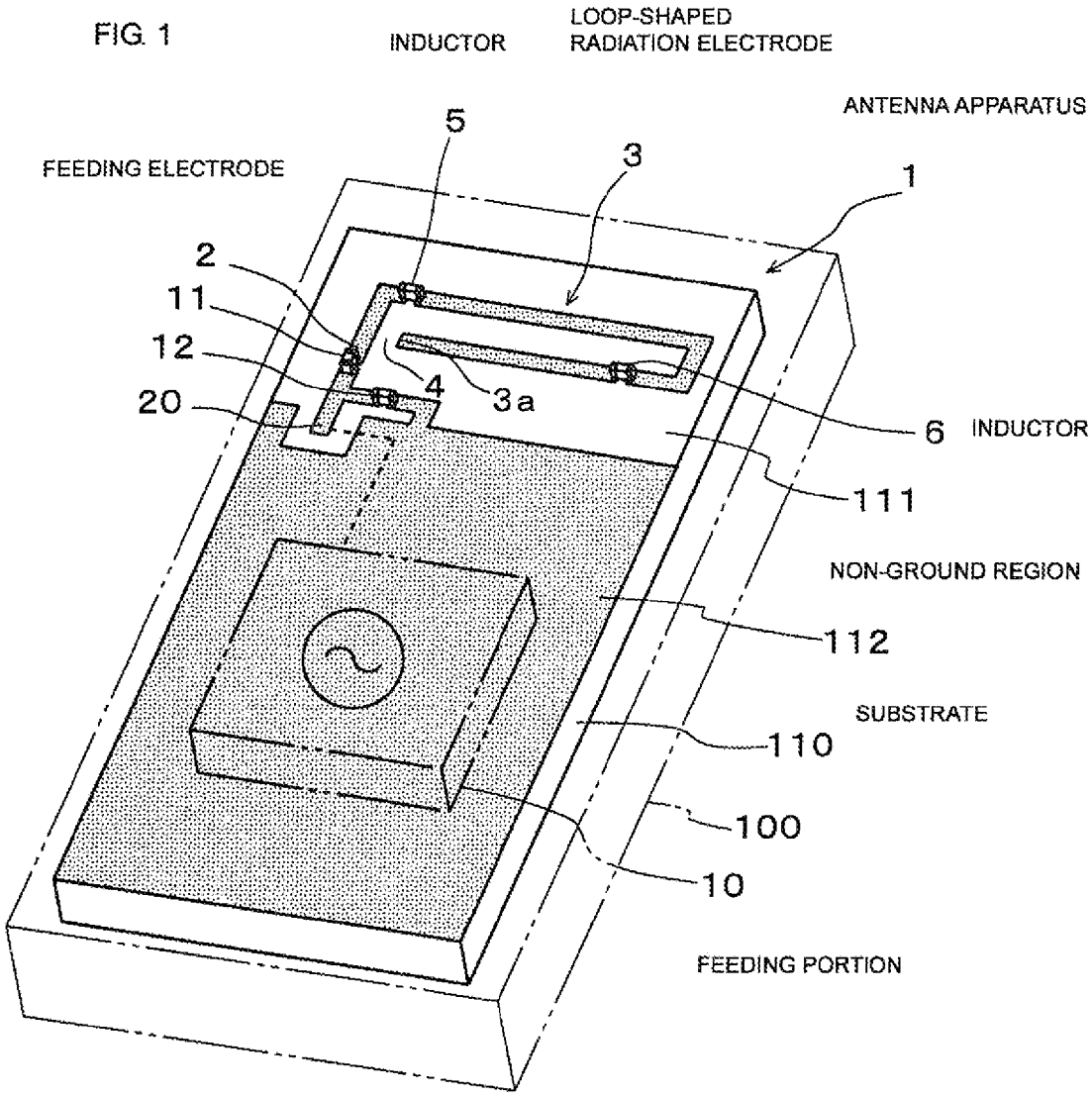
FIG. 1 is a schematic perspective view of an antenna apparatus according to a first embodiment of the present invention included in a radio communication apparatus.
Figure 2:
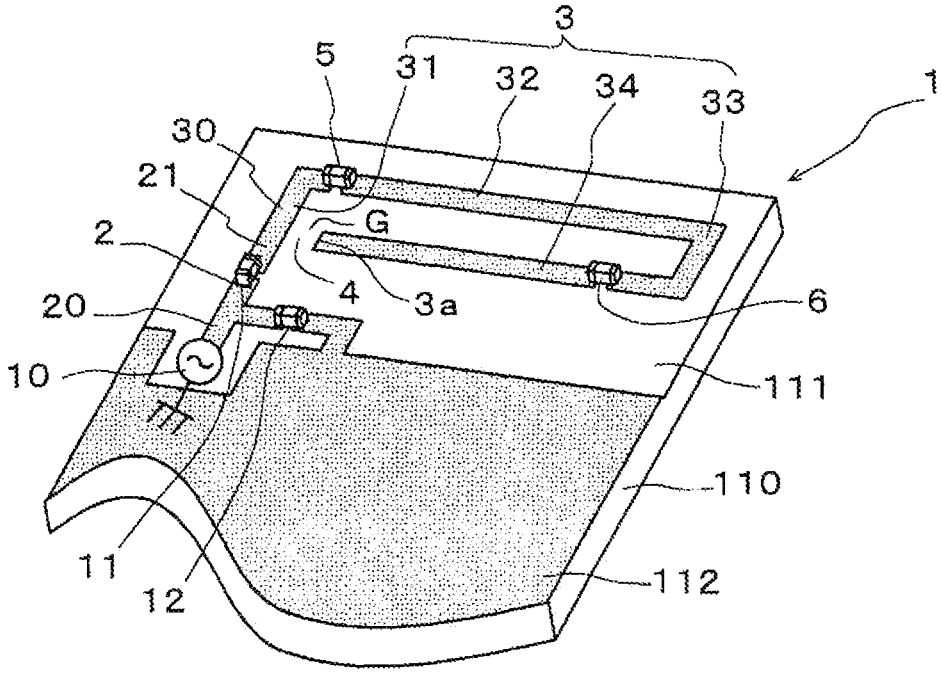
FIG. 2 is an enlarged perspective view of the antenna apparatus.
Figure 3:
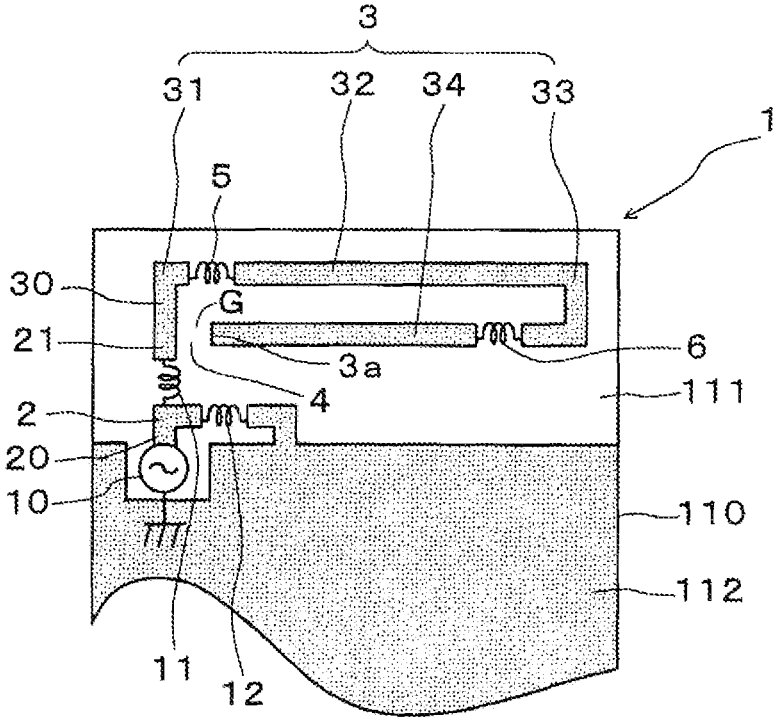
FIG. 3 is a schematic plan view of the antenna apparatus.

FIG. 1 is a schematic perspective view of an antenna apparatus according to the first embodiment of the present invention included in a radio communication apparatus. FIG. 2 is an enlarged perspective view of the antenna apparatus. FIG. 3 is a schematic plan view of the antenna apparatus.

As illustrated in FIG. 1, this radio communication apparatus is a mobile telephone, and includes an antenna apparatus 1 according to the first embodiment of the present invention in a casing 100 thereof. The radio communication apparatus also includes a keyboard, a microphone, a speaker, a liquid crystal panel, and various electronic circuits such as a control unit. However, since these components have known mechanisms, the description thereof and the illustration thereof will be therefore omitted. Accordingly, the antenna apparatus 1 and the mechanism of the antenna apparatus 1 will be described.

The antenna apparatus 1 is a monopole antenna operable in a basic mode and a higher mode, and includes a feeding electrode 2, a loop-shaped radiation electrode 3, a capacitance portion 4, a first reactance circuit 5, and a second reactance circuit 6.

The feeding electrode 2 receives a current of a predetermined frequency from a feeding portion 10 of a transmission/receiving unit indicated by a chain double-dashed line. The feeding electrode 2 is disposed in a non-ground region 111. One end 20 (i.e., lower end in FIG. 1) of the feeding electrode 2 is connected to the feeding portion 10 connected to a ground region 112. In FIG. 2 and the following drawings, for simplification of illustration, the feeding portion 10 is directly connected to the one end 20 of the feeding electrode 2.

The loop-shaped radiation electrode 3 is a horizontally-oriented rectangular loop-shaped electrode formed on the non-ground region 111. More specifically, as illustrated in FIGS. 2 and 3, the loop-shaped radiation electrode 3 includes a left-side portion 31 that has a base end 30 coupled to the other end 21 of the feeding electrode 2 and vertically extends toward the top end of the substrate 110, an upper-side portion 32 coupled to the top end of the left-side portion 31, a right-side portion 33 coupled to the right end of the upper-side portion 32, and a lower-side portion 34 coupled to the lower end of the right-side portion 33. The left end of the lower-side portion 34, that is, an open end 3*a* of the loop-shaped radiation electrode 3, faces the other end 21 of the feeding electrode 2.

The capacitance portion 4 passes a current I2 of a resonance frequency f2 in a higher mode to be described later and blocks a current I1 of a resonance frequency f1 in a basic mode to be described later. The capacitance portion 4 is formed by a gap G between the open end 3*a* of the loop-shaped radiation electrode 3 and the feeding electrode 2.

The first reactance circuit 5 passes the current I1 of the resonance frequency f1 in the basic mode and blocks the current I2 of the resonance frequency f2 in the higher mode. In this embodiment, the first reactance circuit 5 is a chip inductor 5 having a simple configuration. The inductor 5 is provided on the upper-side portion 32 of the loop-shaped radiation electrode 3. More specifically, the inductor 5 is disposed on the left-end portion of the upper-side portion 32 so that the inductor 5 is near the base end 30 and the capacitance portion 4.

The second reactance circuit 6 passes the current I2 of the resonance frequency f2 in the higher mode. In this embodiment, the second reactance circuit 6 is a chip inductor 6 having a simple configuration. The inductor 6 is provided on the side of the open end 3*a* of the loop-shaped radiation electrode 3. More specifically, the inductor 6 is disposed near a position on the right side of the lower-side portion 34 where the resonance frequency f2 of the maximum value in the higher mode is obtained.

In this embodiment, the reactance value of the inductor 5 is set to a value larger than that of the inductor 6. The reactance value of the inductor 6 is set to a value that is smaller than that of the capacitance portion 4 in the basic mode and is larger than that of the capacitance portion 4 in the higher mode.

In the drawings, a reference numeral 11 represents a first matching inductor and a reference numeral 12 represents a second matching inductor. The inductor 11 is disposed on the feeding electrode 2. One end of the inductor 12 is connected to a connecting portion connecting the inductor 11 and the feeding portion 10 to each other and the other end of the inductor 12 is connected to the ground region 112.

Figure 4:
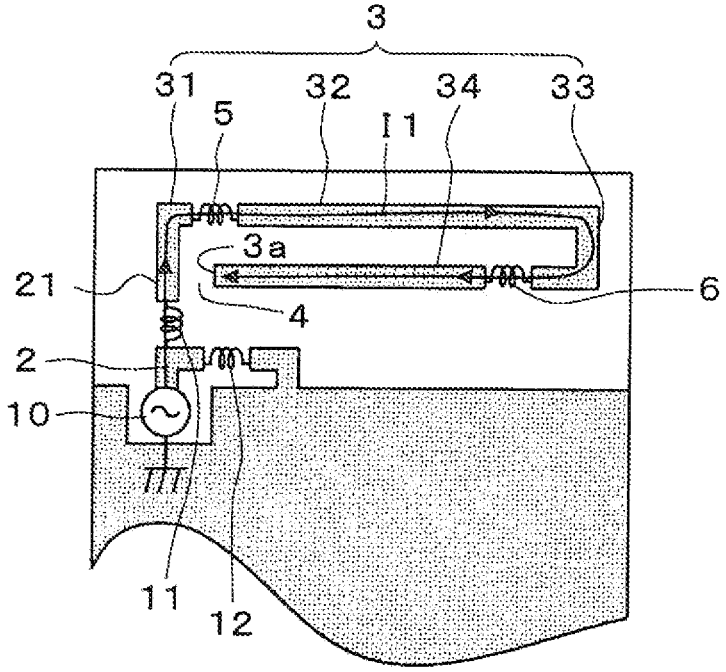
FIG. 4 is a schematic plan view illustrating the flow of a current in a basic mode.
Figure 5:
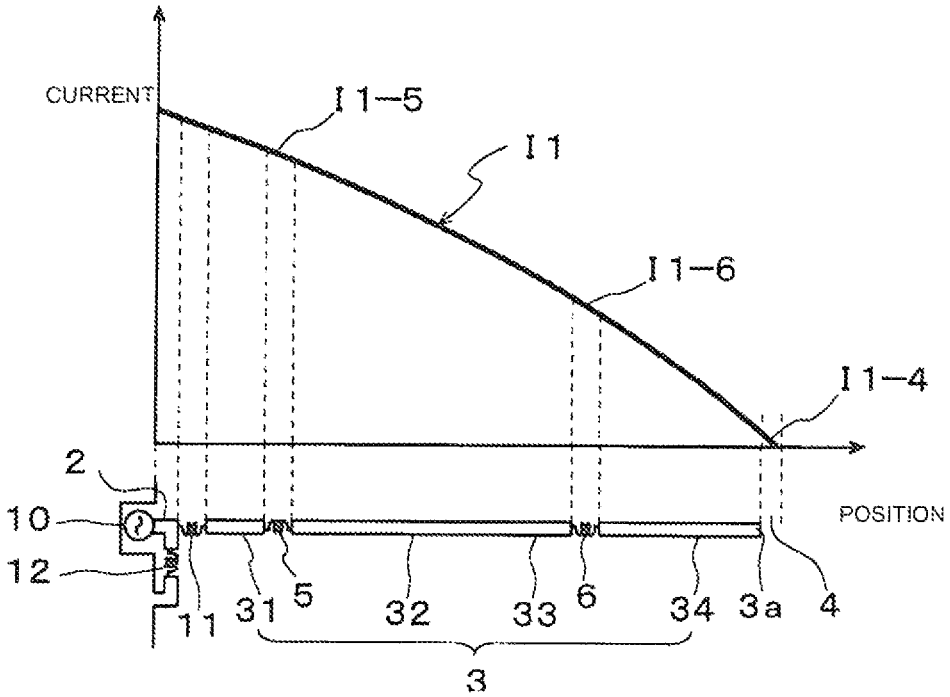
FIG. 5 is a schematic diagram describing a current at each position in the basic mode in an antenna apparatus.

Next, operations and advantages of an antenna apparatus according to this embodiment will be described. FIG. 4 is a schematic plan view illustrating the flow of a current in the basic mode. FIG. 5 is a schematic diagram describing a current at each position in the basic mode in the antenna apparatus.

Referring to FIG. 4, if the current I1 in the basic mode, that is, the current I1 of a low frequency, is supplied from the feeding portion 10 to the feeding electrode 2, the current I1 inputs into the left-side portion 31 of the loop-shaped radiation electrode 3, passes through the inductor 5 disposed on the upper-side portion 32, and reaches the right-side portion 33 without flowing toward the capacitance portion 4 as indicated by an arrow. The reason for this is that the reactance value of the inductor 5 is set to a value smaller than that of the capacitance portion 4 in the basic mode.

Since the reactance value of the inductor 6 is smaller than that of the inductor 5, the current I1 also passes through the inductor 6, reaches the capacitance portion 4, and is blocked at the capacitance portion 4. As a result, the current I1 is distributed as illustrated in FIG. 5. That is, the maximum value of the current I1 is obtained on the side of the feeding electrode 2, the value of the current I1 is reduced toward the open end 3*a* of the loop-shaped radiation electrode 3, and a current I1-4 of the minimum value is obtained at the capacitance portion 4.

As is apparent from FIG. 5, since the inductor 5 is on the side of the feeding electrode 2, a current I1-5 passing through the inductor 5 is extremely large. Accordingly, by changing the reactance value of the inductor 5, it is possible to easily change the resonance frequency f1 in the basic mode in the antenna apparatus 1.

Figure 6:
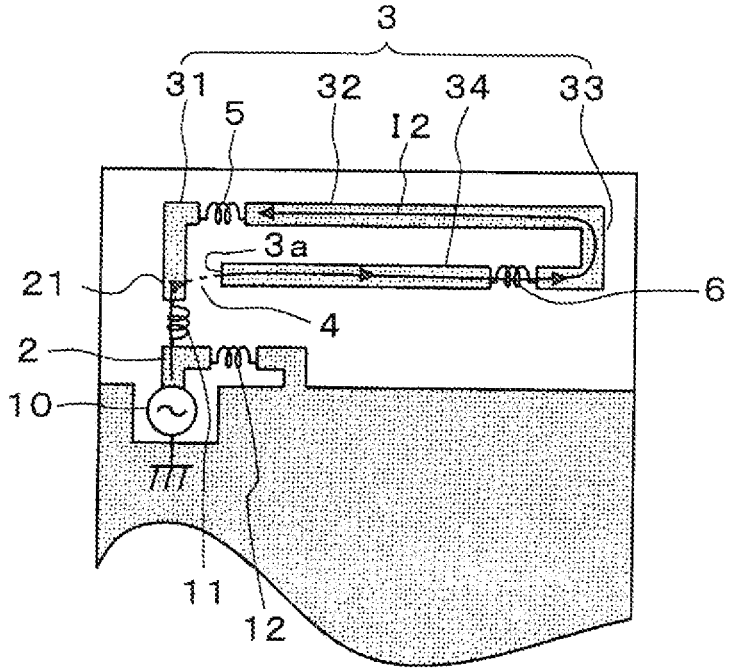
FIG. 6 is a schematic plan view illustrating the flow of a current in a higher mode.
Figure 7:
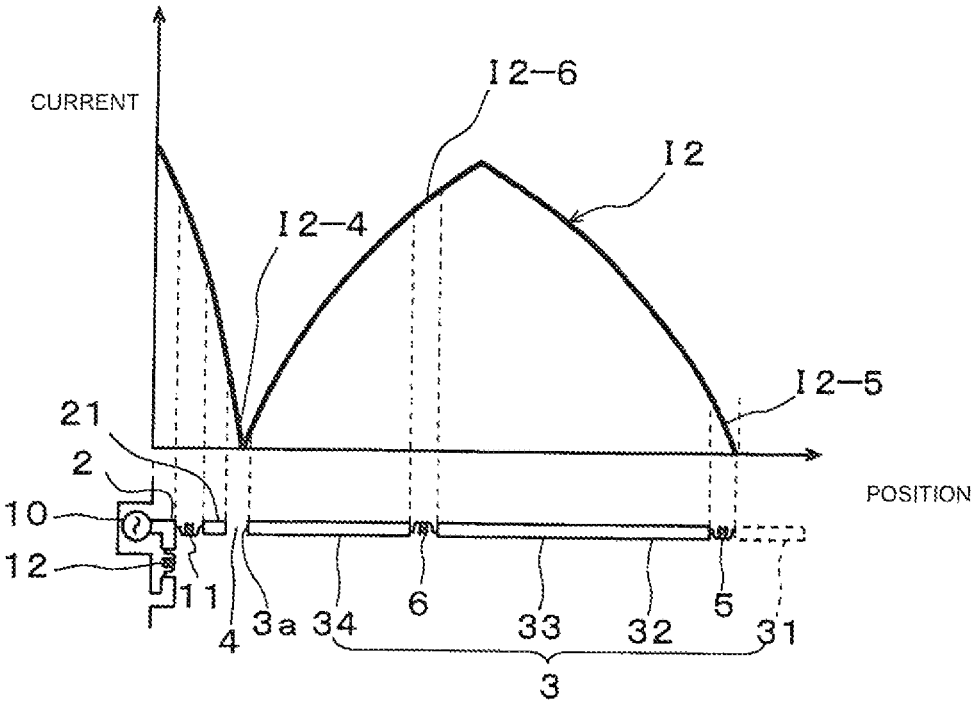
FIG. 7 is a schematic diagram describing a current at each position in the higher mode in an antenna apparatus.

FIG. 6 is a schematic plan view illustrating the flow of a current in the higher mode. FIG. 7 is a schematic diagram describing a current at each position in the higher mode in the antenna apparatus.

Referring to FIG. 6, if the current I2 in the higher mode, that is, the current I2 of a high frequency, is supplied from the feeding portion 10 to the feeding electrode 2, the current I2 does not flow into the left-side portion 31 of the loop-shaped radiation electrode 3. The reason for this is that the reactance value of the capacitance portion 4 is set so that it is smaller than that of the inductor 5 in the higher mode.

As indicated by an arrow, the current I2 flows into the capacitance portion 4 due to capacitive coupling of the capacitance portion 4, and inputs from the open end 3*a* of the loop-shaped radiation electrode 3 to the lower-side portion 34. After the current I2 has passed through the inductor 6 on the lower-side portion 34, the current I2 reaches the upper-side portion 32 from the right-side portion 33 and is blocked at the inductor 5. As a result, the current I2 is distributed as illustrated in FIG. 7. That is, the maximum value of the current I2 is obtained on the side of the feeding electrode 2, the value of the current I2 is reduced toward the other end 21, and a current I2-4 of the minimum value is obtained at the capacitance portion 4. The value of the current I2 is increased toward a center portion from the open end 3*a* of the loop-shaped radiation electrode 3, and the maximum value of the current I2 is obtained near a coupling portion coupling the lower-side portion 34 and the right-side portion 33 to each other. The value of the current I2 is reduced toward the inductor 5 on the upper-side portion 32, and a current I2-5 of the minimum value is obtained at the inductor 5.

As is apparent from FIG. 7, since the inductor 6 is on the right side of the lower-side portion 34 of the loop-shaped radiation electrode 3, a current I2-6 passing through the inductor 6 is extremely large. Accordingly, by changing the reactance value of the inductor 6, it is possible to easily change the resonance frequency f2 in the higher mode in the antenna apparatus 1.

Thus, it is possible to control the resonance frequency f1 in the basic mode by changing the reactance value of the inductor 5, and it is possible to control the resonance frequency f2 in the higher mode by changing the reactance value of the inductor 6. Furthermore, in the antenna apparatus 1 according to this embodiment, it is possible to separately control the resonance frequency f1 and the resonance frequency f2. That is, as illustrated in FIG. 7, since the inductor 5 is disposed at a position where the current I2-5 of the minimum value is obtained in the higher mode, the change in the reactance value of the inductor 5 does not affect the current I2 in the higher mode. Accordingly, even if the reactance value of the inductor 5 is changed so as to change the resonance frequency f1, the resonance frequency f2 in the higher mode is not changed.

On the other hand, as illustrated in FIG. 5, since the inductor 6 is disposed at a position where a current I1-6 of a small value is obtained in the basic mode, the change in the reactance value of the inductor 6 does not affect the current I1 in the basic mode. Accordingly, even if the reactance value of the inductor 6 is changed so as to change the resonance frequency f2, the resonance frequency f1 in the basic mode is not changed.

Figure 8:
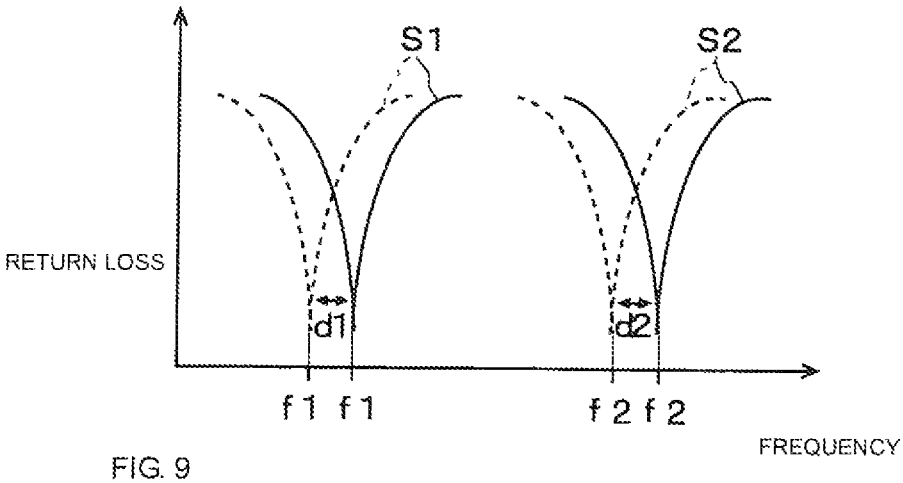
FIG. 8 is a diagram illustrating a return loss curve at each resonance frequency in an antenna apparatus.

FIG. 8 is a diagram illustrating a return loss curve at each resonance frequency in the antenna apparatus 1. As described previously, since the change in one of the resonance frequency f1 in the basic mode and the resonance frequency f2 in the higher mode does not affect the other one of them, it is possible to independently change a return loss curve S1 in the basic mode within a frequency band d1 and a return loss curve S2 in the higher mode within a frequency band d2 as illustrated in FIG. 8.

Thus, according to the first embodiment, it is possible to separately control the resonance frequency f1 in the basic mode and the resonance frequency f2 in the higher mode. Furthermore, since the first reactance circuit 5 and the second reactance circuit 6 are the inductors 5 and 6 having simple configurations, respectively, it is possible to reduce the number of components. This leads to the cost reduction of the antenna apparatus 1.

Figure 9:
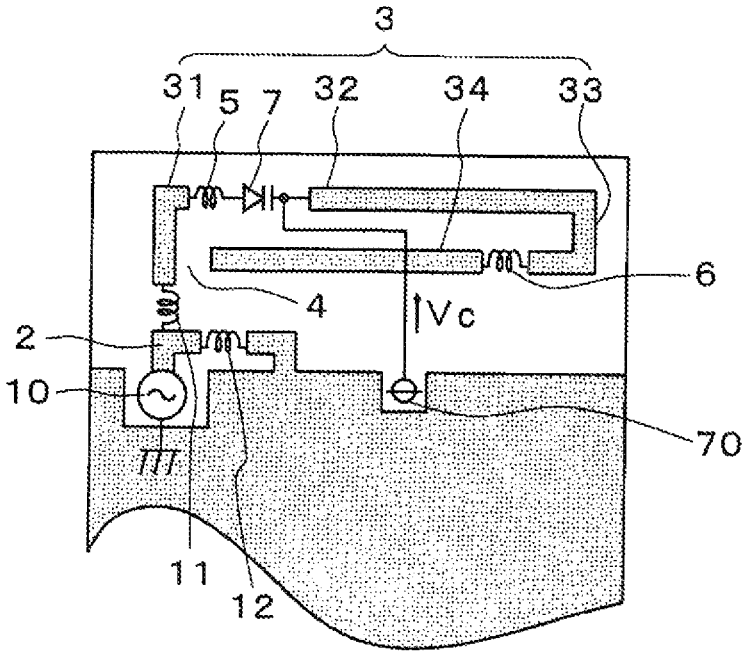
FIG. 9 is a schematic plan view illustrating an antenna apparatus according to a second embodiment.

FIG. 9 is a schematic plan view illustrating an antenna apparatus according to the second embodiment of the present invention. An antenna apparatus according to this embodiment differs from an antenna apparatus according to the first embodiment in that a variable-capacitance element 7 is connected in series to the inductor 5. More specifically, the variable-capacitance element 7 is a diode.

The anode of the variable-capacitance element 7 is connected to the inductor 5, and the cathode of the variable-capacitance element 7 is connected to the upper-side portion 32 of the loop-shaped radiation electrode 3. A direct-current control voltage Vc supplied from a direct-current power source 70 can be applied to the cathode of the variable-capacitance element 7.

Figure 10:
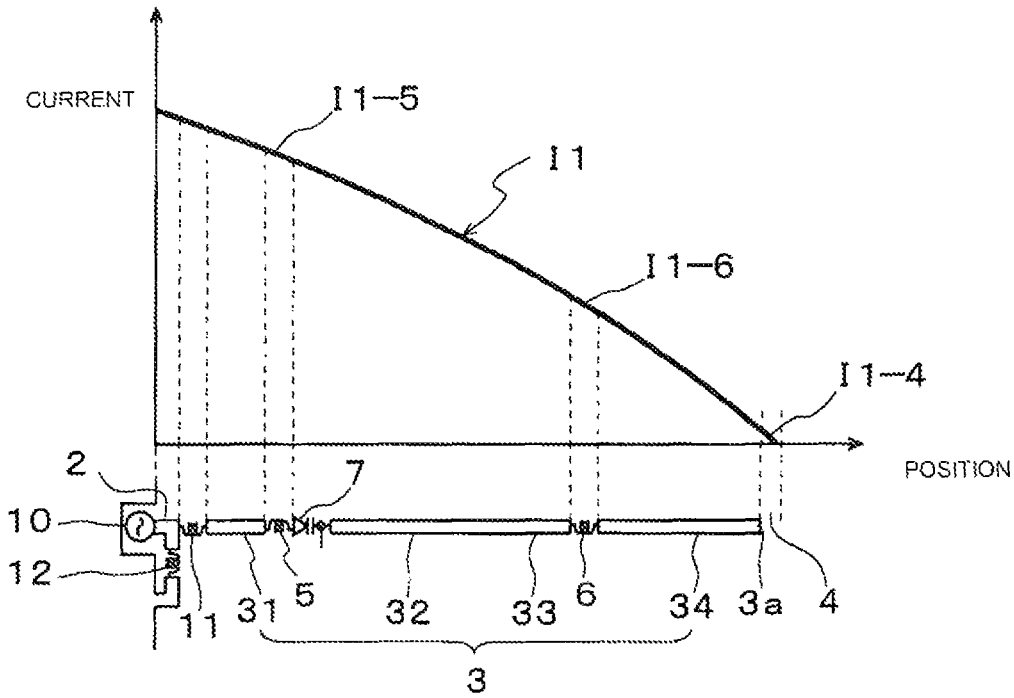
FIG. 10 is a schematic diagram describing a current at each position in the basic mode in the antenna apparatus.
Figure 11:
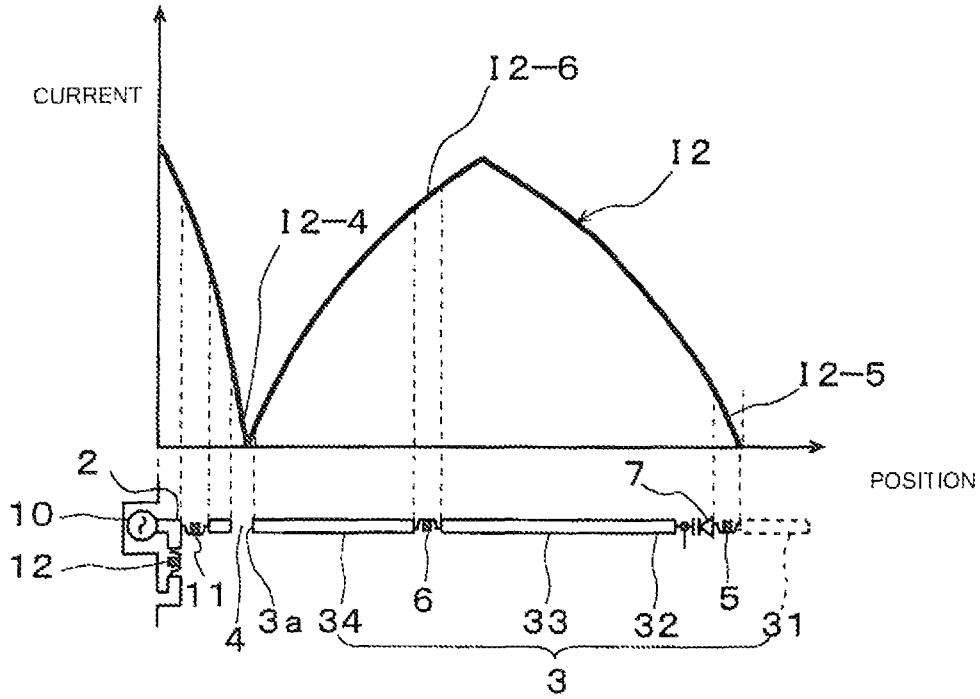
FIG. 11 is a schematic diagram describing a current at each position in the higher mode in the antenna apparatus.
Figure 12:
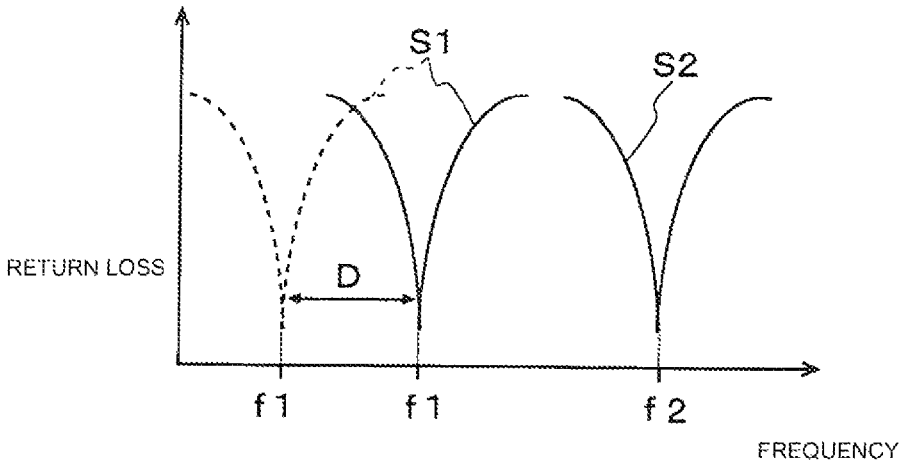
FIG. 12 is a diagram illustrating a return loss curve at each resonance frequency in an antenna apparatus.

FIG. 10 is a schematic diagram describing a current at each position in the basic mode in the antenna apparatus. FIG. 11 is a schematic diagram describing a current at each position in the higher mode in the antenna apparatus. FIG. 12 is a diagram illustrating a return loss curve at each resonance frequency in the antenna apparatus 1. If the direct-current control voltage Vc is input into the cathode of the variable-capacitance element 7 from the direct-current power source 70, the capacitance of the variable-capacitance element 7 is changed in accordance with a voltage value of the direct-current control voltage Vc. Accordingly, since the variable-capacitance element 7 is disposed at a position where the current I1-5 of an extremely large value is obtained as illustrated in FIG. 10, it is possible to easily change the resonance frequency f1 in the basic mode by changing the capacitance value of the variable-capacitance element 7.

As illustrated in FIG. 11, since the variable-capacitance element 7 is disposed at a position where the current I2-5 of the minimum value in the higher mode is obtained, the change in the capacitance value of the variable-capacitance element 7 does not affect the resonance frequency f2 in the higher mode. The variable-capacitance element 7 has an extremely wide capacitance variation range. Accordingly, by changing the capacitance value of the variable-capacitance element 7 after setting the reactance values of the inductors 5 and 6, it is possible to change only the resonance frequency f1 within an extremely wide frequency range D as illustrated in FIG. 12. Therefore, in the antenna apparatus 1, for example, it is possible to use the resonance frequency f1 in the basic mode as a frequency for digital terrestrial television broadcasting and the resonance frequency f2 in the higher mode as a frequency for GPS (Global Positioning System).

By using the variable-capacitance element 7 while fixing the resonance frequency f2 for GPS to approximately 1.6 GHz, it is possible to tune the resonance frequency f1 for digital terrestrial television broadcasting within a wide range of 470 MHz to 770 MHz.

The other configurations, operations, and advantages of an antenna apparatus according to this embodiment are similar to those of an antenna apparatus according to the first embodiment and the description thereof will be therefore omitted.

Figure 13:
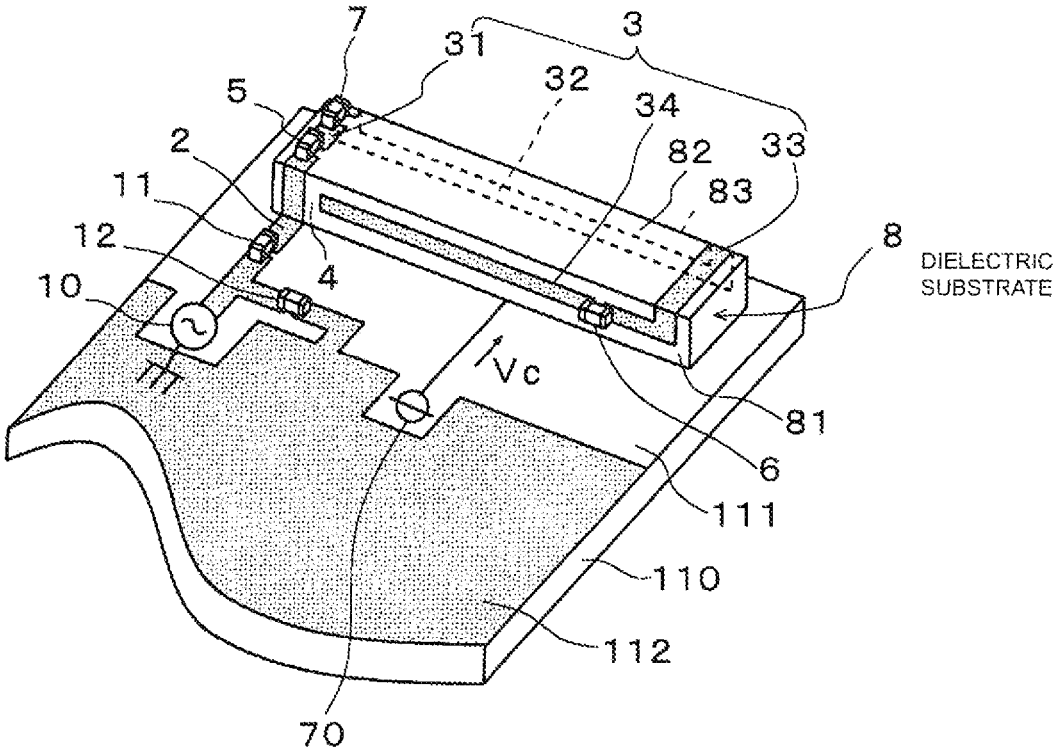
FIG. 13 is an enlarged perspective view of an antenna apparatus according to a third embodiment of the present invention.

Next, the third embodiment of the present invention will be described. FIG. 13 is an enlarged perspective view of an antenna apparatus according to the third embodiment of the present invention. An antenna apparatus according to this embodiment differs from antenna apparatuses according to the first and second embodiments in that the feeding electrode 2, the loop-shaped radiation electrode 3, etc. are disposed on a dielectric substrate 8.

More specifically, the rectangular parallelepiped dielectric substrate 8 is disposed on the non-ground region 111 of the substrate 110. A part of the feeding electrode 2 extends to a front surface 81 of the dielectric substrate 8, and the left-side portion 31 of the loop-shaped radiation electrode 3 extends to a back surface 83 of the dielectric substrate 8 through the front surface 81 and a top surface 82 of the dielectric substrate 8. The upper-side portion 32 is formed on the back surface 83. The right-side portion 33 is formed in the right-side portion of the dielectric substrate 8 so that the right-side portion 33 extends to the front surface 81 through the back surface 83 and the top surface 82. The lower-side portion 34 is formed on the front surface 81. The inductor 5 and the variable-capacitance element 7 are provided on the left-side portion 31 of the loop-shaped radiation electrode 3. The inductor 6 is provided on the lower-side portion 34.

In an antenna apparatus having the above-described configuration, since the capacitive coupling of the capacitance portion 4 is extremely strong, it is possible to easily control the resonance frequency f2 in the higher mode. Furthermore, since the feeding electrode 2, the loop-shaped radiation electrode 3, the inductors 5 and 6, the variable-capacitance element 7, etc., which are components of the antenna apparatus 1, are three-dimensionally disposed on the dielectric substrate 8, the width of the loop-shaped radiation electrode 3 is reduced and the footprint of the antenna apparatus 1 can be therefore reduced.

The other configurations, operations, and advantages of an antenna apparatus according to this embodiment are the same as those of antenna apparatuses according to the first and second embodiments, and the description thereof will be therefore omitted.

Figure 14:
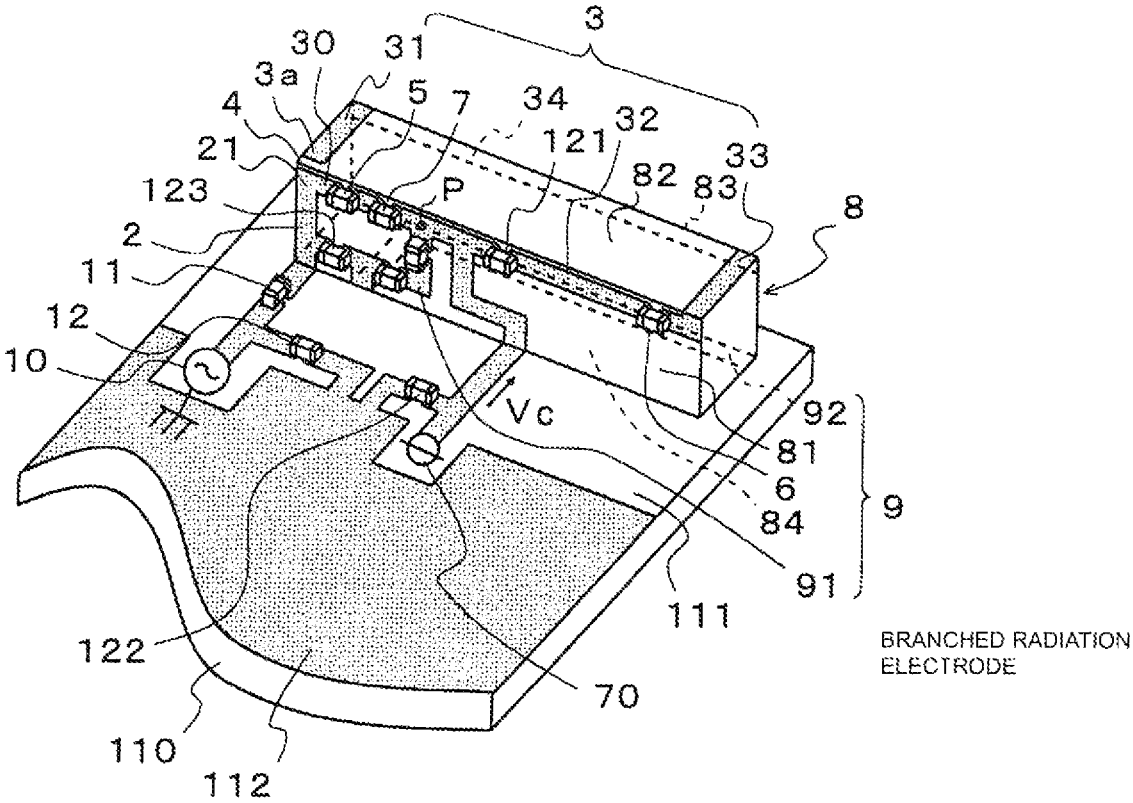
FIG. 14 is an enlarged perspective view of an antenna apparatus according to a fourth embodiment of the present invention.
Figure 15:
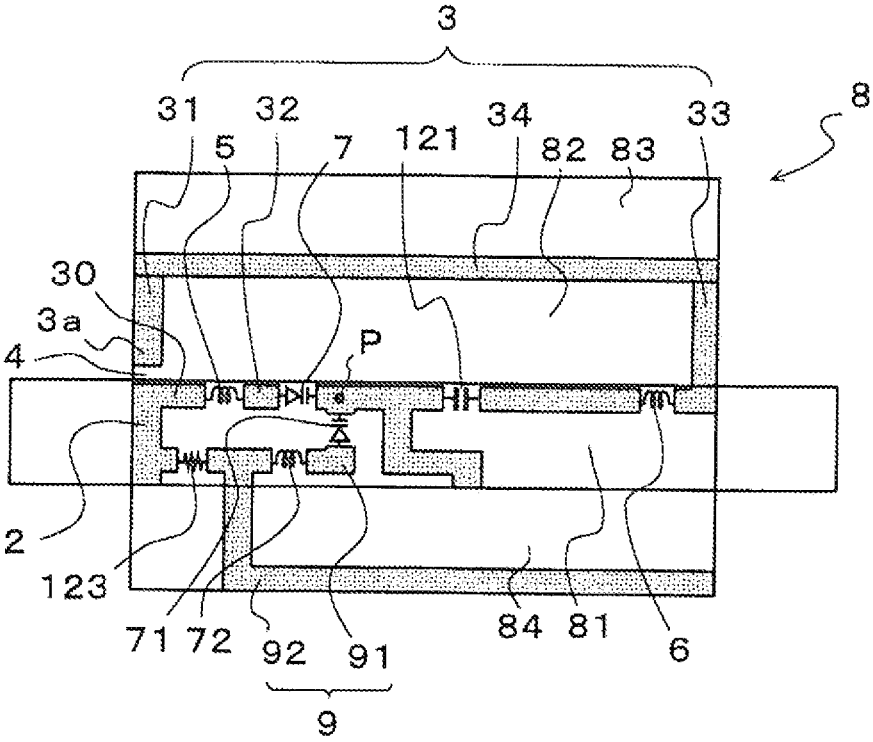
FIG. 15 is a plan view in which each surface of a dielectric substrate according to the fourth embodiment is developed.

Next, the fourth embodiment of the present invention will be described. FIG. 14 is an enlarged perspective view of an antenna apparatus according to the fourth embodiment of the present invention. FIG. 15 is a plan view in which each surface of the dielectric substrate 8 is developed.

An antenna apparatus according to this embodiment differs from antenna apparatuses according to the above-described embodiments in that a branched radiation electrode that branches off from the loop-shaped radiation electrode 3 is added and the first reactance circuit 5 and the second reactance circuit 6 are disposed on only the front surface of the dielectric substrate 8. That is, as illustrated in FIGS. 14 and 15, in an antenna apparatus according to this embodiment, a branched radiation electrode 9 is added to the loop-shaped radiation electrode 3, and tall components such as the inductors 5 and 6, which are the first and second reactance circuits, respectively, the variable-capacitance element 7, and a variable-capacitance element 71 are disposed on the front surface 81 of the dielectric substrate 8.

Unlike loop-shaped radiation electrodes according to the above-described embodiments, the loop-shaped radiation electrode 3 has an outer winding loop shape. That is, the base end 30 is coupled to the other end 21 of the feeding electrode 2, the upper-side portion 32 is horizontally formed at the top of the front surface 81 of the dielectric substrate 8, the right-side portion 33 is coupled to the right end of the upper-side portion 32 and is formed on the right side of the top surface 82, the lower-side portion 34 is coupled to the leading end of the right-side portion 33 and is horizontally formed at the top of the back surface 83, and the left-side portion 31 is coupled to the left end of the lower-side portion 34 and is formed on the left side of the top surface 82. The open end 3*a* of the left-side portion 31 faces the other end 21 of the feeding electrode 2, so that the capacitance portion 4 is formed. The inductors 5 and 6 are provided on the upper-side portion 32 of the loop-shaped radiation electrode 3. The variable-capacitance element 7 is connected in series to the inductor 5. A capacitor 121 is a direct-current cut capacitor, and prevents migration from occurring due to the application of a direct-current voltage to the capacitance portion 4 when the loop-shaped radiation electrode 3 is made of silver.

On the other hand, the branched radiation electrode 9 branches off near the inductor 5 formed on the loop-shaped radiation electrode 3. More specifically, a branched base portion 91 is formed on the front surface 81 of the dielectric substrate 8 so that it branches off at a point P on the upper-side portion 32 of the loop-shaped radiation electrode 3, and a branched body portion 92 extends from the branched base portion 91 to an undersurface 84 in the L-letter shape. The branched radiation electrode 9 is composed of the branched base portion 91 and the branched body portion 92. The variable-capacitance element 71 and an inductor 72 functioning as a reactance circuit are provided on the branched base portion 91 of the branched radiation electrode 9. More specifically, the cathode of the variable-capacitance element 71 is on the side of the point P, and the inductor 72 is connected to the anode of the variable-capacitance element 71. As a result, the direct-current control voltage Vc supplied from the direct-current power source 70 can be applied to the cathode of the variable-capacitance element 71.

In order to apply a direct-current voltage to the variable-capacitance element 71, the branched radiation electrode 9 and the feeding electrode 2 are connected to each other using a resistor 123. The variable-capacitance element 71 is connected to the ground via the inductor 72, the resistor 123, and the inductors 11 and 12.

As in antenna apparatuses according to the above-described embodiments, in an antenna apparatus according to this embodiment including the feeding electrode 2 and the loop-shaped radiation electrode 3, it is possible to transmit/receive radio waves using the loop-shaped radiation electrode 3 at a resonance frequency in the basic mode and a resonance frequency in the higher mode. Furthermore, it is possible to control the resonance frequency in the basic mode and the resonance frequency in the higher mode using the inductors 5 and 6 and to tune the resonance frequency in the basic mode using the variable-capacitance element 7 within a wide range.

On the other hand, in an antenna apparatus according to this embodiment including the feeding electrode 2, the upper-side portion 32 of the loop-shaped radiation electrode 3 up to the point P, and the branched radiation electrode 9, it is possible to transmit/receive radio waves at another resonance frequency in the basic mode using the branched radiation electrode 9.

Furthermore, it is possible to control the other resonance frequency in the basic mode using the inductors 5 and 72 and to tune the other resonance frequency in the basic mode within a wide range using the variable-capacitance elements 7 and 71.

Thus, according to an antenna apparatus according to this embodiment, it is possible to transmit/receive radio waves in many frequency ranges by increasing the number of resonance frequencies in the basic mode. Furthermore, it is possible to dispose the loop-shaped radiation electrode 3 at an allowable antenna height by disposing tall components such as the inductor 5 on the front surface 81 of the dielectric substrate 8. As a result, an antenna apparatus can be further minimized, and the efficiency of an antenna apparatus can be further enhanced.

Figure 16:
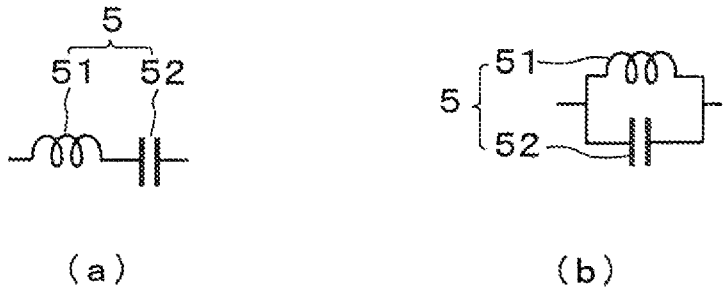
FIG. 16 is a circuit diagram of a first reactance circuit used in an antenna apparatus according to a fifth embodiment.
Figure 17:
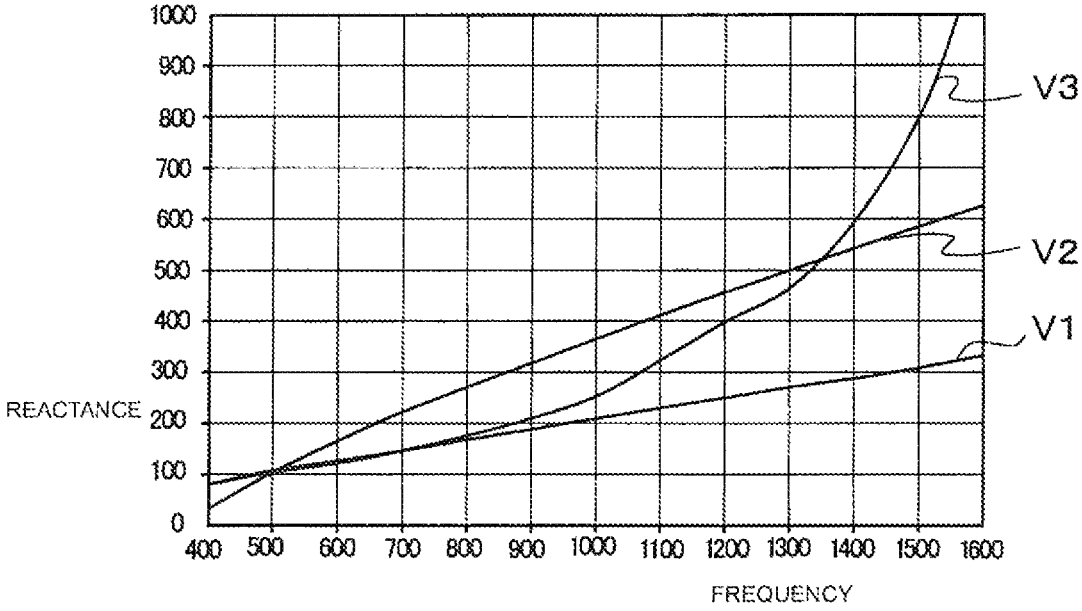
FIG. 17 is a diagram illustrating the relationships between a reactance and a frequency when the first reactance circuit is formed of a single inductor, a series circuit, and a parallel circuit.
Figure 18:
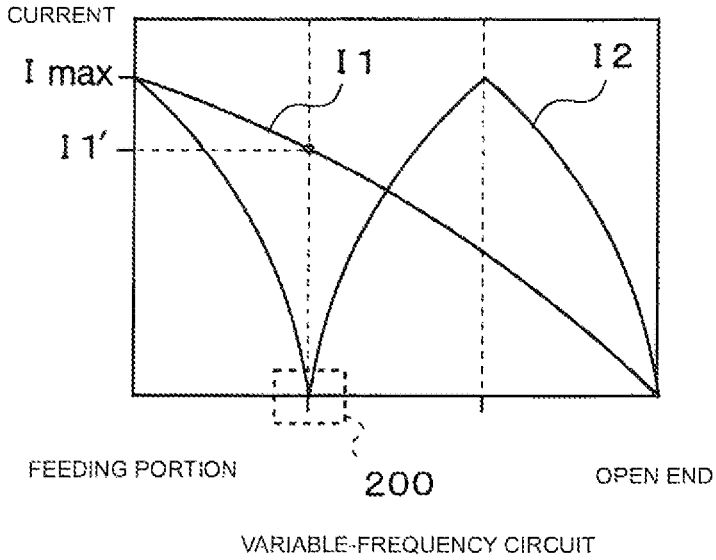
FIG. 18 is a diagram describing the relationships between a current and a variable-frequency circuit in a basic mode and a higher mode in an antenna apparatus in the related art.

Next, the fifth embodiment of the present invention will be described. FIG. 16 is a circuit diagram of a first reactance circuit used in an antenna apparatus according to the fifth embodiment. FIG. 17 is a diagram illustrating the relationships between a reactance and a frequency when a first reactance circuit is formed of a single inductor, a series circuit, and a parallel circuit.

An antenna apparatus according to the fifth embodiment differs from an antenna apparatuses according to the above-described embodiments in that the first reactance circuit is formed of a series circuit or a parallel circuit including an inductor and a capacitor. The first reactance circuit 5 is a circuit for passing a current of a resonance frequency in the basic mode and blocking a current of a resonance frequency in the higher mode. Accordingly, the first reactance circuit 5 is required to have a low reactance value at a low frequency and a large reactance value at a high frequency.

In the above-described embodiments, the first reactance circuit 5 is formed of a single inductor, that is, the inductor 5, in which a reactance value varies slightly in accordance with the change in frequency. Accordingly, as indicated by a reactance curve V1 in FIG. 17, a desired reactance value of 100Ω can be obtained at a frequency of approximately 500 MHz in the basic mode, but a reactance value of 300Ω that is an insufficient value is obtained at a frequency of approximately 1.5 GHz in the higher mode.

On the other hand, if the first reactance circuit 5 is formed of a series circuit including an inductor 51 and a capacitor 52 as illustrated in FIG. 16(*a*), a large reactance value of 580Ω can be obtained at a frequency of approximately 1.5 GHz in the higher mode as indicated by a reactance curve V2 in FIG. 17.

Furthermore, if the first reactance circuit 5 is formed of a parallel circuit including the inductor 51 and the capacitor 52 as illustrated in FIG. 16(*a*), an extremely large reactance value of 800Ω can be obtained at a frequency of approximately 1.5 GHz in the higher mode as indicated by a reactance curve V3 in FIG. 17.

That is, in an antenna apparatus according to this embodiment, by using a series circuit or a parallel circuit including the inductor 51 and the capacitor 52 as the first reactance circuit 5, it is possible to hold a small reactance value at a resonance frequency in the basic mode and to achieve a large reactance value at a resonance frequency in the higher mode. As a result, the efficiency of blocking a current in the higher mode can be enhanced. The other configurations, operations, and advantages of an antenna apparatus according to this embodiment are the same as those of antenna apparatuses according to the first to fourth embodiments, and the description thereof will be therefore omitted.

The present invention is not limited to the above-described embodiments, and various modifications and changes can be made within the scope of the present invention. For example, although the second reactance circuit 6 is formed of a simple inductor, that is, the inductor 6, in the above-described embodiments, the second reactance circuit 6 may be formed of a series circuit or a parallel circuit including an inductor and a capacitor as described in the fifth embodiment. Furthermore, although a single branched radiation electrode, that is, the branched radiation electrode 9, is disposed in the fourth embodiment, any number of branched radiation electrodes may be formed. For example, two or more branched radiation electrodes may branch off near the first reactance circuit.

What is claimed is:

1. An antenna apparatus, comprising:

a feeding electrode;

a loop-shaped radiation electrode in a non-ground region of a substrate to operate at a resonance frequency in a basic mode and a resonance frequency in a higher mode, the feeding electrode having a first end connected to a feeding portion to supply a current of a predetermined frequency, the loop-shaped radiation electrode extending in a state where a base end of the loop-shaped radiation electrode is connected to a second end of the feeding electrode and having an open end facing the second end of the feeding electrode;

a capacitance portion to pass a current of the resonance frequency in the higher mode and to block a current of the resonance frequency in the basic mode, the capacitance portion being formed by a gap between the open end of the loop-shaped radiation electrode and the feeding electrode;

a first reactance circuit positioned on the loop-shaped radiation electrode and configured to pass a current of the resonance frequency in the basic mode and to block a current of the resonance frequency in the higher mode; and a second reactance circuit positioned on the loop-shaped radiation electrode and configured to pass a current of the resonance frequency in the higher mode, wherein along a path from the base end to the open end, the second reactance circuit is positioned on the loop-shaped electrode closer to the open end than the first reactance circuit, and closer to a position where a maximum current of the resonance frequency in the higher mode is obtained than the first reactance circuit.

2. The antenna apparatus according to claim 1, wherein a reactance value of the first reactance circuit is larger than that of the second reactance circuit, a reactance value of the first reactance circuit is smaller than that of the capacitance portion in the basic mode, and a reactance value of the first reactance circuit is larger than that of the capacitance portion in the higher mode.

3. The antenna apparatus according to claim 1, wherein a variable-capacitance element is connected in series to the first reactance circuit.

4. The antenna apparatus according to claim 1, wherein each of the first reactance circuit and the second reactance circuit is an inductor.

5. The antenna apparatus according to claim 1, wherein the first reactance circuit is a series circuit or a parallel circuit including an inductor and a capacitor, and the second reactance circuit is an inductor.

6. The antenna apparatus according to claim 1, wherein the loop-shaped radiation electrode, the feeding electrode, the capacitance portion, the first reactance circuit, and the second reactance circuit are disposed on a dielectric substrate disposed on the non-ground region.

7. The antenna apparatus according to claim 6, wherein the first reactance circuit and the second reactance circuit are disposed on only a side surface of the dielectric substrate.

8. The antenna apparatus according to claim 1, wherein a first matching inductor is disposed between the feeding electrode and the feeding portion, and a second matching inductor is disposed so that one end of the second matching inductor is connected to a connecting portion connecting the first matching inductor and the feeding portion to each other and another end of the second matching inductor is connected to a ground region of the substrate.

9. The antenna apparatus according to claim 1, wherein one or more branched radiation electrodes that branch off from the loop-shaped radiation electrode near the first reactance circuit are disposed.

10. A radio communication apparatus, comprising:

an antenna apparatus including a feeding electrode;

a loop-shaped radiation electrode in a non-ground region of a substrate to operate at a resonance frequency in a basic mode and a resonance frequency in a higher mode, the feeding electrode having a first end connected to a feeding portion to supply a current of a predetermined frequency, the loop-shaped radiation electrode extending in a state where a base end of the loop-shaped radiation electrode is connected to a second end of the feeding electrode and having an open end facing the second end of the feeding electrode;

a capacitance portion to pass a current of the resonance frequency in the higher mode and to block a current of the resonance frequency in the basic mode, the capacitance portion being formed by a gap between the open end of the loop-shaped radiation electrode and the feeding electrode;

a first reactance circuit positioned on the loop-shaped radiation electrode and configured to pass a current of the resonance frequency in the basic mode and to block a current of the resonance frequency in the higher mode; and a second reactance circuit positioned on the loop-shaped radiation electrode and configured to pass a current of the resonance frequency in the higher mode, wherein along a path from the base end to the open end, the second reactance circuit is positioned on the loop-shaped electrode closer to the open end than the first reactance circuit, and closer to a position where a maximum current of the resonance frequency in the higher mode is obtained than the first reactance circuit.

11. The radio communication apparatus according to claim 10, wherein a reactance value of the first reactance circuit is larger than that of the second reactance circuit, a reactance value of the first reactance circuit is smaller than that of the capacitance portion in the basic mode, and a reactance value of the first reactance circuit is larger than that of the capacitance portion in the higher mode.

12. The radio communication apparatus according to claim 10, wherein a variable-capacitance element is connected in series to the first reactance circuit.

13. The radio communication apparatus according to claim 10, wherein each of the first reactance circuit and the second reactance circuit is an inductor.

14. The radio communication apparatus according to claim 10, wherein the first reactance circuit is a series circuit or a parallel circuit including an inductor and a capacitor, and the second reactance circuit is an inductor.

15. The radio communication apparatus according to claim 10, wherein the loop-shaped radiation electrode, the feeding electrode, the capacitance portion, the first reactance circuit, and the second reactance circuit are disposed on a dielectric substrate disposed on the non-ground region.

16. The antenna apparatus according to claim 15, wherein the first reactance circuit and the second reactance circuit are disposed on only a side surface of the dielectric substrate.

17. The radio communication apparatus according to claim 10, wherein a first matching inductor is disposed between the feeding electrode and the feeding portion, and a second matching inductor is disposed so that one end of the second matching inductor is connected to a connecting portion connecting the first matching inductor and the feeding portion to each other and the other end of the second matching inductor is connected to a ground region of the substrate.

18. The radio communication apparatus according to claim 10, wherein one or more branched radiation electrodes that branch off from the loop-shaped radiation electrode near the first reactance circuit are disposed.

* * * * *